United States Patent [19]

Moredock et al.

[11] 4,242,961

[45] Jan. 6, 1981

[54] CHEVRON GROOVED DECOUPLING OBTURATOR

[75] Inventors: Jerry L. Moredock; James E. Wagner; Jonnie O. Hyder, all of Orlando, Fla.

[73] Assignee: Martin Marietta Corporation, Orlando, Fla.

[21] Appl. No.: 953,731

[22] Filed: Oct. 23, 1978

[51] Int. Cl.[3] ..... F42B 31/00

[52] U.S. Cl. ..... 102/93; 102/92.1

[58] Field of Search ..... 102/52, 92.2, 92.4, 102/93, 92.1

[56] References Cited

U.S. PATENT DOCUMENTS

| | | | |
|---|---|---|---|
| 2,996,012 | 8/1961 | Butler | 102/93 |
| 3,769,912 | 11/1961 | Friend | 102/93 |
| 3,786,760 | 1/1974 | Feldmann | 102/93 |
| 3,847,082 | 11/1974 | Feldmann | 102/93 |
| 3,939,773 | 2/1976 | Jenkins et al. | 102/93 |

*Primary Examiner*—Leland A. Sebastian

*Attorney, Agent, or Firm*—Julian C. Renfro; Gay Chin

[57] ABSTRACT

An obturator for a projectile to be fired from a rifled barrel is provided in accordance with this invention, with this obturator being mounted on the projectile in such a way as to permit rotational slippage. A preferred form of our obturator comprises a ring of non-metalic material, which ring is capable of being mounted on a circular body portion of the projectile. An external portion of the obturator ring has a plurality of encircling slots, essentially parallel to each other, which slots are rearwardly inclined so as to define a plurality of chevron-like members designed to forcibly engage the rifling of the barrel. The interior of the obturator ring is designed to slip rotationally with respect to the projectile body portion as the projectile travels along the barrel, thereby advantageously minimizing the rotation of the projectile as a result of rifling effects. One embodiment of an obturator in accordance with this invention may be designed to disintegrate as it leaves the barrel, whereas another embodiment may utilize an overwrap of high temperature filamentary material in at least some of the slots, which overwrap serves to increase the hoop strength of the obturator.

4 Claims, 6 Drawing Figures

CHEVRON GROOVED DECOUPLING OBTURATOR

BACKGROUND OF THE INVENTION

Ever since the introduction of the rifled gun barrel, various types of bands of comparatively soft material known as obturators have been utilized around the circumference of a projectile for engaging the rifling to a sufficient extent to effect a seal for preventing blowby of gases, and to assure that the projectile will be rotating at a rapid rate as it leaves the gun barrel. The typical rotational rate may be 200 revolutions per second, which serves to provide a desirable amount of stability for an ordinary projectile.

With the advent of ammunition that includes special type warheads, it has become desirable to provide a means for limiting the spin rate of a projectile to a low number of revolutions per second. Along this line the Thompson U.S. Pat. No. 3,208,345 proposed an expander disc arranged to move forward upon the firing of the projectile, with this disk serving to expand the rearwardly extending flange of a disc such that it effectively engages the rifling of the weapon tube. This arrangement was sometimes satisfactory for use with certain projectiles, but it was found to be too heavy and complicated for use with projectiles fired from large bore gun barrels, and in addition, it could not withstand the considerable heat built up by a gun barrel after repeated firings.

It was quite obvious that a very definite need existed for a decoupling obturator which would serve the multiple, often conflictory purposes of providing an effective seal to prevent the undesirable escape of gases on the one hand, while on the other hand effectively decoupling the projectile so that it would spin only at a rate of say 5 to 20 revolutions per second as it left a rifled gun barrel, which is roughly 1/10th the spin rate that would ensue if a suitable decoupling means were not provided.

SUMMARY OF THE INVENTION

In accordance with this invention, we have provided a decoupling obturator of nonmetallic construction for use with sophisticated projectiles, which serves in a highly suitable way to engage the rifling of a weapon barrel, thus to prevent a loss of the gases utilized for providing the initial thrust to the projectile. At the same time, our novel obturator serves the most important function of effectively decoupling the projectile from the rifling so that it does not rotate faster than say 5 to 20 revolutions per second, for to spin at a faster rate would damage sensitive components utilized for guidance, control and other such purposes in the projectile.

Many conflicting criteria must be taken into consideration in the design of a decoupling obturator, for although on the one hand decoupling must be very dependably brought about, on the other hand the obturator must be able to initially engage the rifling of the weapon tube with sufficient force as will prevent the projectile from becoming dislodged from contact with the rifling should the weapon barrel be moved to an elevated position, or should it be subjected to certain accelerational forces.

Over and above these and other considerations, the decoupling obturator must be able to withstand weapon barrel temperatures of at least 400 degrees F. for several minutes, and even temperatures up to 800 degrees F. for short periods under certain circumstances.

After a large number of designs and much experimentation, we have evolved two different types of highly successful obturators incorporating a novel chevron design and usable upon projectiles and other devices to be fired from rifled gun barrels, with such obturators effectively serving to provide a dependable amount of decoupling while also being able to withstand the harsh operating conditions to which they will be subjected.

One embodiment of our novel decoupling obturator is designed for Army use, which carries the criteria that the obturator remain with the projectile for the entire duration of its flight. This requirement is imposed inasmuch as friendly troops may be located forward of the muzzle of the weapon tube, and should the decoupling obturator fly apart by the time it reaches the end of the weapon barrel, fragments of the obturator might be injurious, if not lethal, to the troops in the vicinity of the gun.

On the other hand, for Navy use we propose a decoupling obturator of chevron design, designed to fragment shortly after leaving the barrel of the weapon, in that way to lessen the drag of the missile, and so as to provide a needed boost to performance.

The exterior surface of each of our obturator embodiments is characterized by the use of a series of rearwardly inclined, encircling grooves that serve to define circumferentially disposed chevron-like members, with durable material that will conform to the rifling of the weapon barrel being utilized. In this way, loss of high pressure gases around the projectile is effectively prevented, while at the same time the rearwardly extending chevron-like members assure the retention of the projectile in the gun tube forcing cone.

For the embodiment in which it is desired to retain the obturator on the projectile throughout its flight, the grooves that serve to define the chevron serve as ideal locations for receiving many turns of a filament constructed of high strength material, which filament of course serves to considerably increase hoop strength and thereby prevent fragmentation of the obturator at the time it leaves the gun barrel.

As to the embodiment designed to fragment subsequent to launch, our basic obturator is quite useful and highly effective, even though it does not utilize a wrap of filamentary material.

It is therefore seen to be a primary object of this invention to provide a decoupling obturator of low cost, that will enable a projectile launched from a rifled barrel to rotate at only a fraction of the velocity at which it would otherwise rotate.

It is another object of our invention to provide a decoupling obturator of durable material utilizing a series of rearwardly inclined grooves about its periphery, with such grooves defining chevron-like members that conform to the rifling of a gun barrel to effectively prevent blowby.

It is yet another object of our invention to provide a decoupling obturator whose exterior utilizes novel chevron-like members, with such members being defined by encircling grooves adaptable in some embodiments of our invention to receive an overwrap of high strength fibers that serve to increase the hoop strength of the obturator.

These and other objects, features and advantages will be more apparent as the description proceeds.

DETAILED DESCRIPTION

Figure 1:
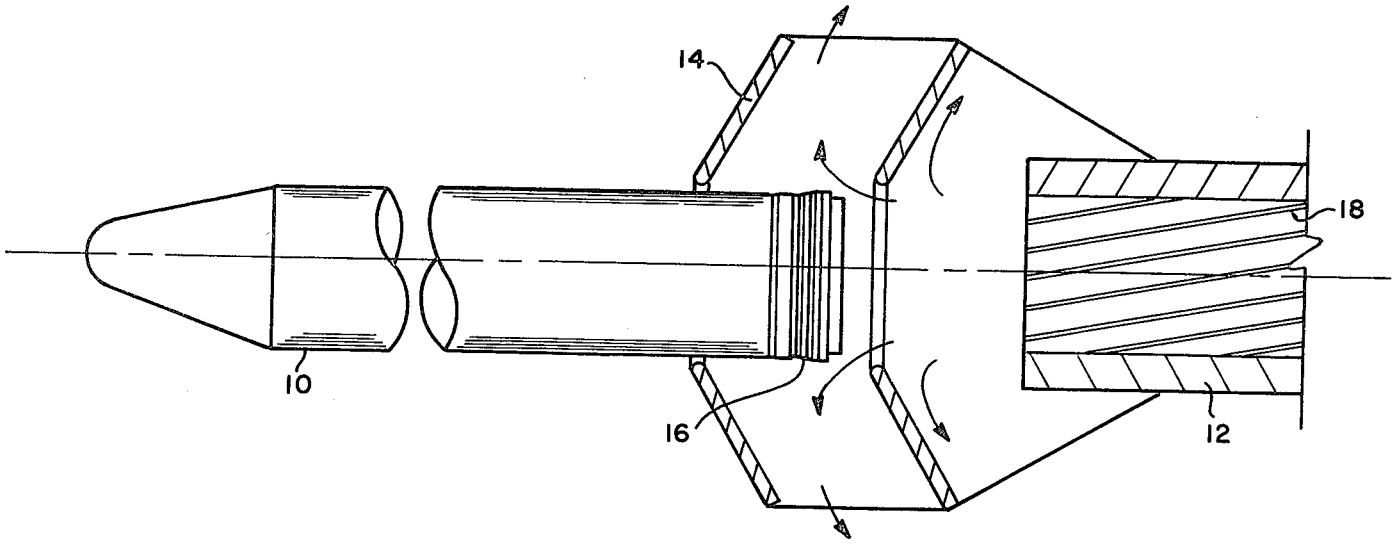
FIG. 1 is a side elevational view of a projectile utilizing our novel obturator, as the projectile is fired from a rifled gun barrel, with the barrel being sectioned to reveal internal construction.

Referring to FIG. 1, we have there shown a projectile 10 being fired from a rifled gun barrel 12, with a muzzle brake 14 being used in this instance in order to minimize recoil. The several arrows appearing in this figure indicate typical flow paths for the high pressure gas leaving the barrel 12.

Upon the aft portion of the projectile 10, a novel decoupling obturator 16 is utilized in accordance with this invention, with this device being responsible for the performance of several important functions, including the minimization of the spin of the projectile as it leaves the rifled gun barrel.

Figure 2:
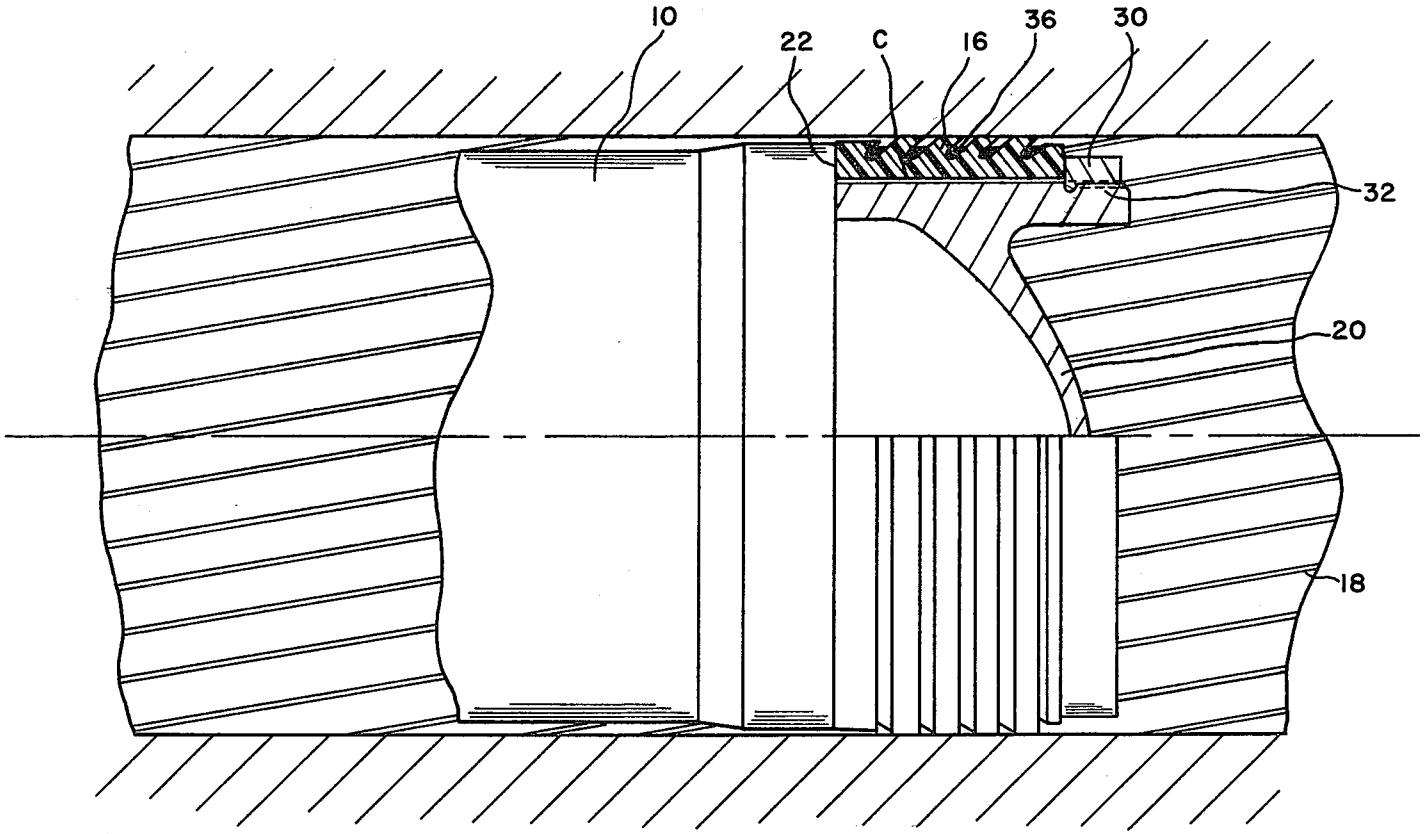
FIG. 2 is a view to a larger scale of the sectioned portion of a gun barrel, in which an obturator in accordance with our invention is revealed, partly in section.

Referring to FIG. 2, it will be seen from this enlarged fragmentary showing of a missile in a gun barrel that a certain amount of clearance normally exists between the projectile 10 and the rifling 18 of the gun barrel, but at the aft end of the projectile, our novel decoupling obturator 16 fits rather tightly in the rifling, thus preventing the flow of high pressure gas around the projectile.

It will be seen from a close inspection of FIG. 2 that the obturator 16 mounts upon a structural aft portion 20 of the projectile, with it being desirable for a considerable amount of slippage to occur between the obturator 16 and the portion 20 as the projectile travels along the gun barrel. As an example, an ordinary projectile equipped with a conventional obturator might well be spinning in the vicinity of 10,000 rpm as it leaves a rifled gun barrel, but because of the steps taken in accordance with this invention to encourage slippage between the obturator and the aft portion of the projectile, the projectile will be spinning only about 1/10th of this speed as it leaves the gun barrel 12.

Figure 3:
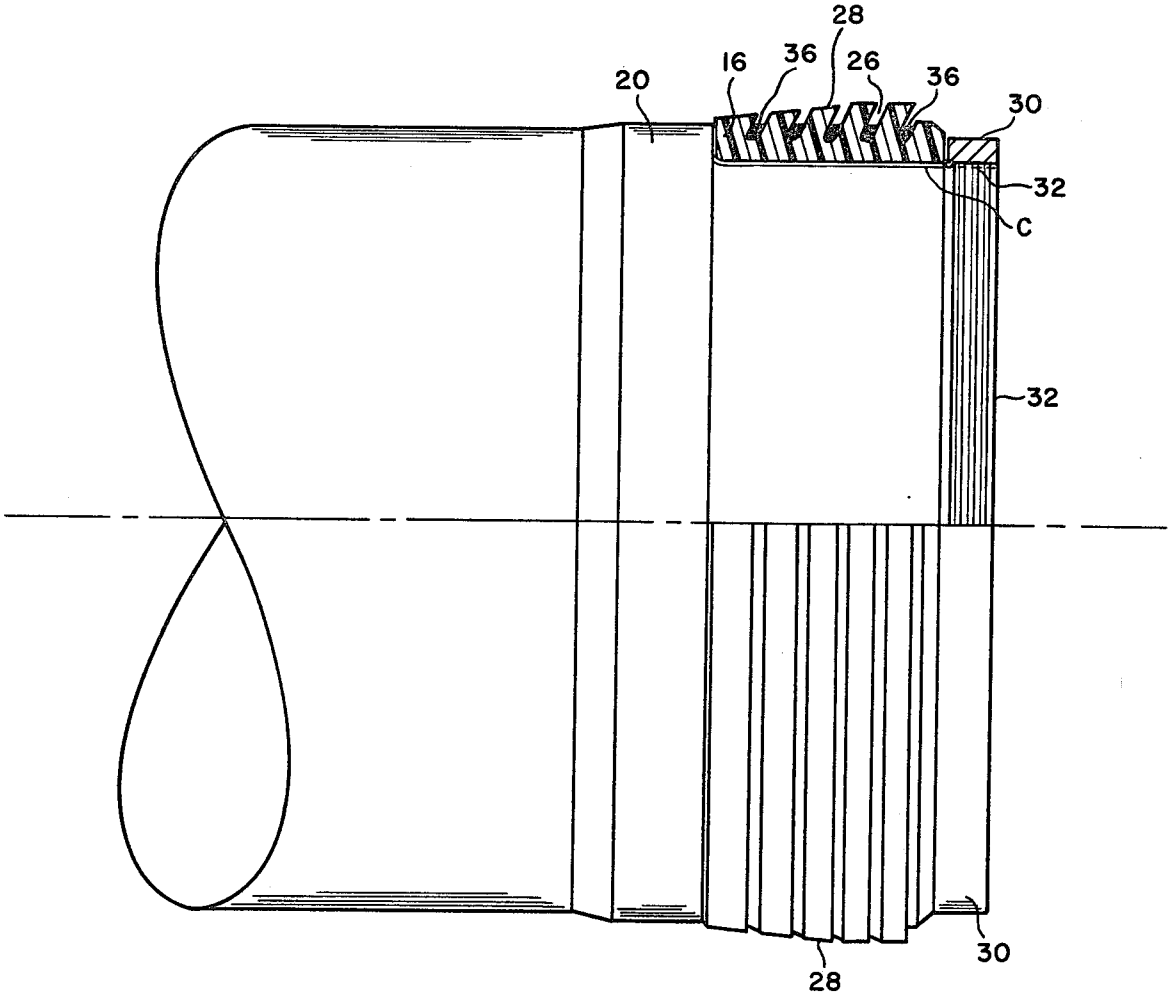
FIG. 3 is a view to a still larger scale of an embodiment in which an overwrap of filamentary material is used in the grooves of the obturator in order to increase hoop strength.
Figure 5:
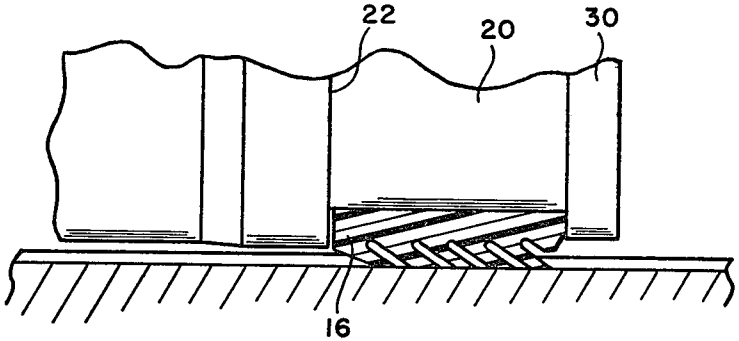
FIGS. 4 and 5 are fragmentary views revealing the relationship of the chevron portions of our obturator to the rifling of the gun barrel.
Figure 4:
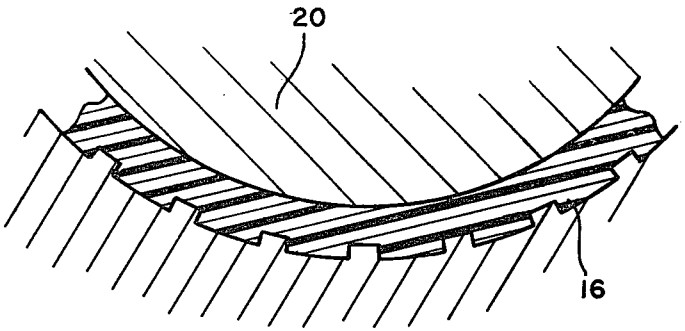

It will be noted from FIG. 2, but in greater detail in FIG. 3, that the outer surface of our novel obturator 16 is equipped with a plurality of say five encircling grooves 26 that are rearwardly inclined. These serve to define what we prefer to call chevrons because of the rearwardly sloped arrangement. The obturator in this embodiment is preferably made of 127E nylon, which is comparatively hard, but it is nevertheless capable of deforming as the projectile is caused during the loading procedure to move firmly into the gun tube forcing cone. In other words, the chevron-like encircling members 28 engage the rifling of the gun quite tightly, with the chevron members being deformed substantially at the locations where the rifling is contacted; note FIGS. 4 and 5.

There is preferably 0.001 to 0.002 inches of clearance at location C between the inside of the obturator ring and the outer surface of the aft portion 20 of the projectile, so that the obturator ring 16 is enabled to turn with respect to the projectile structure in order to provide an effective decoupling, while at the same time maintaining a highly effective gas seal. The nylon preferably used in the construction of the obturator is naturally slippery and usually does not require a lubricant in order to turn easily with respect to the aft portion 20, but a lubricant may be used at location C if desired.

Although we are not to be limited to such, we prefer to hold the obturator 16 in the proper operative fore and aft relationship with respect to the structural aft portion 20 by the use of a nut 30 which engages the threads 32 encircling the rearmost part of the aft portion 20, as will be noted in FIGS. 2 and 3. The nut is tightened only to a sufficient extent that the ring 16 contacts the shoulder 22, but not to such an extent as to make forced contact therewith. Reinforcement for ring 16 in the form of filamentary material 36 may be used in the grooves 26 in the manner shown in FIG. 3, particularly if it is desired for the obturator ring to remain on the projectile throughout its flight. The filamentary material is preferably of Kevlar or Fiberglas and if used, serves to provide a considerable amount of hoop strength to the obturator.

Figure 6:
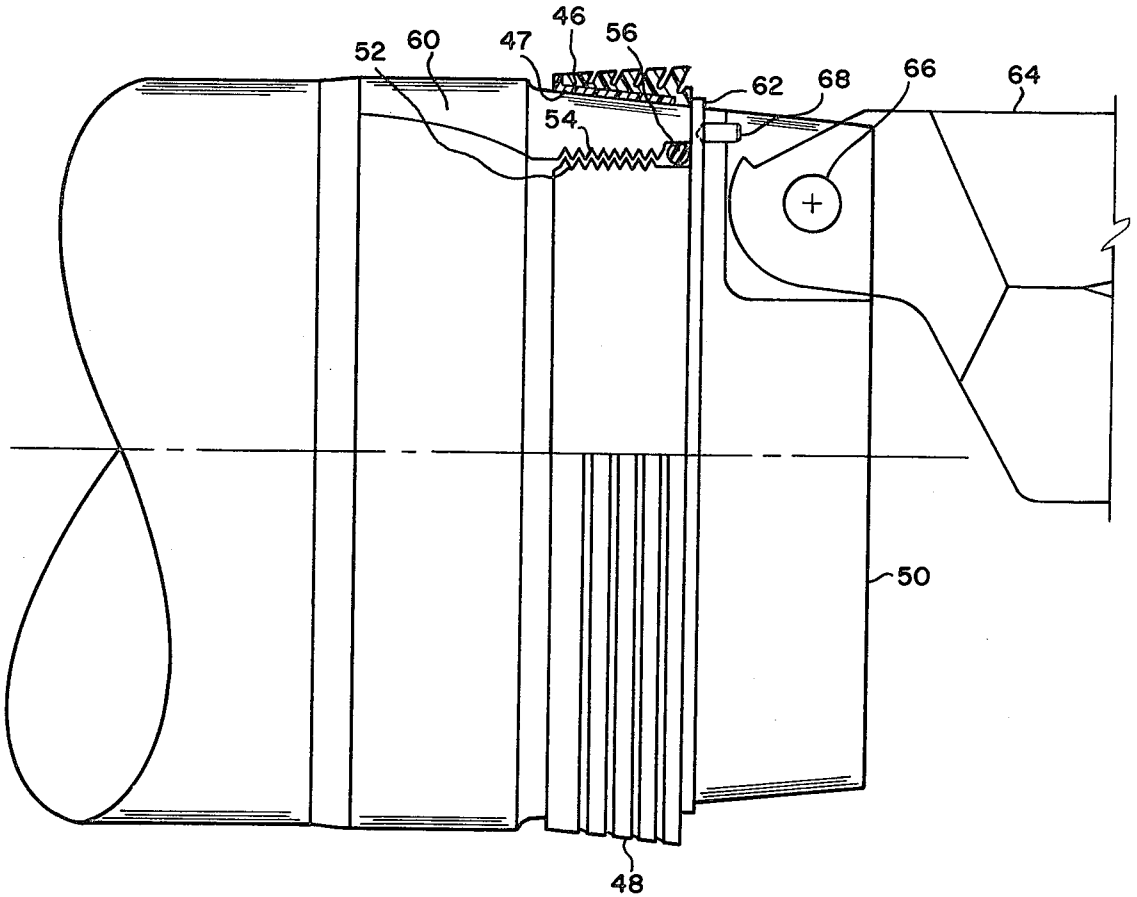
FIG. 6 is a view of the rear portion of a projectile equipped with another type of obturator than that illustrated in FIG. 2.

Turning to FIG. 6, we have there shown a version of our invention particularly adapted for incorporation into a projectile to be used aboard ship, or other such location where there need be no particular concern for damage in the area in front of the gun barrel resulting from the obturator flying apart rather than remaining on the projectile. This is to say, on the embodiment depicted in FIG. 6, the obturator 46 is not provided with a circumferential wrap of filamentary material in its grooves, and where no such wrap is to be used, the grooves defining the chevron-like encircling members 48 do not need to be as large or as deep in the embodiment depicted in FIG. 3.

The obturator utilized in the embodiment for shipboard use shown in FIG. 6 may be of 127E nylon, although we prefer to use an obturator of asbestos—phenolic if the projectile is to be used in an automatic weapon, where chamber temperatures often reach 800° F. Inasmuch as asbestos—phenolic does not possess the natural slipperiness of nylon, and may tend to sieze on the projectile afterbody, we prefer to use a nylon slip band 47 directly under and forward of the obturator 46 in the event asbestos phenolic is used. The slip band is ring shaped, with a conical outer contour that mates with a matching contour on the asbestos—phenolic ring. Also, the nylon is configured so that nylon is present in the form of a shoulder encircling the forward edge of the asbestos—phenolic ring, to facilitate decoupling and sealing. The nylon ring does not extend to the aft edge of the obturator and therefore does not affect the retention capability of the remaining nut or ring.

The obturator of FIG. 6 is preferably held in an operative location by means of a threaded aft closure 50 equipped with encircling threads 52 such that internal threads 54 in the rearmost portion of housing or case 60 may be engaged. An O-ring 56 or other appropriate seal may be utilized adjacent the interfitting threads, and a shoulder 62 is utilized on the member 50 in order to prevent undesired aft movement of the obturator 46.

As will be noted from FIG. 6, the threaded closure 50 forms a support for a plurality of fins 64, and although we are not to be limited to any particular number, in the exemplary embodiment of this invention, six fins are used, which are each rotatably mounted on a respective hinge pin 66. In order to minimize the shock to the structure when the fins are moved from the folded position shown, into the operative position, we provide a crush pin 68 associated with each fin. By locating the crush pin directly in the path of a fin as it moves forwardly, a substantial amount of the energy can be dissipated, thus lessening the likelihood of damage to the structure.

As previously indicated, for shipboard use it is desired for the obturator to shatter shortly after leaving the gun tube, so for that reason, we do not utilize an overwrap of high temperature filaments in the grooves of the obturator. In order to facilitate the fracture of an asbestos—phenolic obturator, we provide fracture lines or weakened portions, or as another example, we can provide a number of holes in the obturator structure such that breaking apart of the obturator near the exit of the gun barrel will be assured. The disappearance of the obturator makes it easier to streamline the projectile and tends to eliminate the vortices otherwise tending to occur near the aft closure member 50.

The nylon slip band is comparatively thin, and provides no consequential amount of residue at such time as the obturator has fragmented. In a typical instance, the nylon slip band will break and in a considerably weakened condition, it will separate from the projectile cleanly.

We claim:

1. An obturator for a projectile to be fired from a barrel having rifling, which obturator is mounted on the projectile in such a way as to permit slippage such that the projectile will be caused to rotate at only a fraction of the rotational speed it would otherwise have attained, said obturator comprising a ring of non-metallic material, which ring is capable of mounting on a circular body portion of the projectile, an external portion of said obturator ring having a plurality of encircling slots, essentially parallel to each other, which slots are rearwardly inclined so as to define a plurality of chevron-like members designed to forcibly engage the rifling of the barrel, the interior of said ring being designed to slip rotationally with respect to the projectile body portion as the projectile travels along the barrel, thus enabling the rotation of the projectile as a result of rifling effects to be minimized.

2. The obturator as defined in claim 1 wherein an overwrap of high temperature filamentary material is utilized in at least some of said slots, which overwrap serves to increase the hoop strength of the obturator.

3. The obturator as defined in claim 1 wherein the obturator is separated from the body portion of the projectile by a slip ring, which slip ring enhances the rotational slippage of the obturator.

4. The obturator as defined in claim 3 wherein said slip ring is nylon, and the obturator is asbestos—phenolic.

* * * * *